United States Patent [19]

Strop et al.

[11] Patent Number: 4,580,720

[45] Date of Patent: Apr. 8, 1986

[54] HEAT PUMP INSTALLATION

[75] Inventors: Heinz Strop, Berlin; Werner Kohler, Bentfeld, both of Fed. Rep. of Germany

[73] Assignee: Siemens Aktiengesellschaft, Munich, Fed. Rep. of Germany

[21] Appl. No.: 655,997

[22] Filed: Sep. 28, 1984

Related U.S. Application Data

[63] Continuation of Ser. No. 496,469, May 20, 1983, abandoned.

[30] Foreign Application Priority Data

May 21, 1982 [DE] Fed. Rep. of Germany ..... 3219680

[51] Int. Cl.[4] ..... F24D 1/00

[52] U.S. Cl. ..... 237/67

[58] Field of Search ..... 237/58, 59, 67; 165/58, 165/60, 61

[56] References Cited

U.S. PATENT DOCUMENTS

| | | | |
|---|---|---|---|
| 2,256,201 | 9/1941 | Hintze . | |
| 2,653,012 | 9/1953 | Thatcher | 237/67 X |
| 3,940,058 | 2/1976 | Norris | 237/67 X |
| 4,260,335 | 4/1981 | Marchal | 237/67 X |
| 4,366,853 | 1/1983 | Bernier | 237/59 X |

*Primary Examiner*—Lloyd L. King

*Attorney, Agent, or Firm*—Kenyon & Kenyon

[57] ABSTRACT

For operating a heat pump installation with water as the refrigerant, a vacuum pump is employed as the compressor. If a liquid ring pump is used, its dissipation heat is fed into the heating loop. To this end, the heat output side of the heat exchanger associated with the loop of the sealing liquid is connected to the primary or secondary heat carrier loop of the heat consumer associated with the refrigerant loop.

9 Claims, 4 Drawing Figures

HEAT PUMP INSTALLATION

This application is a continuation of application Ser. No. 496,469, filed May 20, 1983, now abandoned.

BACKGROUND OF THE INVENTION

This invention relates to heat generation in general and more particularly to heat generation by means of heat pumps and to the system design of heat pump installations.

Presently used, customary heat pump installations operate, as a rule, with three loops: A brine loop on the heat source side, a refrigerant loop in the compression process and a heating medium loop on the consumer side. While water is used as the heating medium, particularly on the consumer side, fluoro-hydrocarbons are preferably used in the compression process. These, however, are at the limit of their applicability at temperatures of somewhat above 90° C. and can therefore not be used for high-temperature heat pumps with heating temperatures of 100° to 120° C. Furthermore, in the known installations, at least two heat exchangers are required for separating the different loops (DE-AS No. 26 26 468).

Starting from a heat pump installation in which a heat collector designed as an evaporator, a compressor and at least one heat consumer are arranged in an open or closed refrigerant loop, it is an object of the present invention to design the heat pump installation, from a system point of view, in such a way that it operates with an efficiency comparable to that of three-loop heat pump installations and can also be used for the generation of heating temperatures above 90° C. with a modest equipment cost.

SUMMARY OF THE INVENTION

According to the present invention, for solving this problem, water is used as the refrigerant and the compressor comprises a vacuum pump.

In such an embodiment of a heat pump installation, by using water, a refrigerant is employed, the pressure range of which is an order of magnitude lower than that of the customarily used fluoro-hydrocarbons. This simplifies the design from a safety point of view and also the requirements as to operation and maintenance. The control requirements are also reduced. Since water can be evaporated in the low vacuum range by using underpressure, the cost for the evaporator and the vacuum pump can also be kept within narrow limits. A particularly advantageous design of the heat pump installation is obtained where a liquid ring pump with a thermo oil as the sealing liquid is used to obtain the vacuum. A heat exchanger may then be arranged in the loop of the sealing liquid, and the heat output side of the heat exchanger may be disposed in the primary or secondary heat carrier loop of the heat consumer.

With the liquid ring pump, which has been known for decades and has been used heretofore either as a vacuum pump for drawing off gases and vapors or as a compressor for compressing gases, predominantly in the chemical industry (see the brochure "Elmo Gas Pumps" of Siemens AG, July, 1964), a proven, low-wear unit is introduced into the heat pump installation. This unit furnishes a relatively large volumetric output with a relatively small pressure increase. It also can operate on the pressure side in the temperature range of 100° to 120° C. The intrinsically relatively large amount of dissipation heat of this pump is fed into the heating loop as additional heating power via the heat exchanger associated with the sealing liquid.

It is essential for the use of the liquid ring pump that a thermo oil is employed instead of the heretofore customary sealing liquid in the form of water. A thermo oil which is distinguished by a high boiling point and low viscosity at the evaporation temperatures is provided. A suitable thermo oil is marketed, for instance, by the firm BP under the designation "Transcal LT".

The new heat pump system can be used, depending on the output temperature of the heat source, in the low temperature range as well as in the high temperature range. If, for instance, river water is used as the heat source, steam with temperatures of about 50° to 70° C. can be generated in the underpressure range. Radiators can then be supplied directly with the steam, the steam being condensed in the radiator. In these cases, the system is designed so that a rough vacuum pump is connected to the steam line between the vacuum pump and the heat consumer, and that the heat consumer is followed by a controlled valve for controlling the amount of condensate in the heat consumer.

If, for instance, the return liquid of a long distance heating network with a temperature of about 50° C. is used as the heat source, steam can be generated in the overpressure range at temperatures of 110° to 120° C. The steam compressed with little overpressure can give off its heat directly or indirectly in an open or closed condenser. An installation, in which, between the vacuum pump and the heat consumer, a direct liquid condenser is arranged is particularly practical. The liquid inlet of condenser is connected to the outlet of the heat consumer. If a liquid ring pump is then used as the vacuum pump, it is advisable, for improving the efficiency of the system and for increasing the heating temperature of the condensate, to arrange the heat exchanger of the liquid ring pump between the condenser and the heat consumer.

If the return of a long distance heating network is used as the heat source, the compressed steam, however, can also be fed to a heat exchanger, in the secondary loop of which the heat consumer itself is located. If a ring pump is employed as the vacuum pump, it is advisable, in this case, to arrange the heat output side of the heat exchanger disposed in the loop of the sealing liquid of the ring pump in the secondary loop of the heat exchanger.

The new heat pump system is suited particularly for industrial processes in the higher temperature range and can be used there simultaneously for cooling and heating purposes. If the vacuum pump is driven by a water cooled combustion engine, the cooling water of the combustion engine is advantageously fed to the heat collector of the heat pump installation as an additional heat source. Thereby, especially in case of low temperatures of the heat source, an evaporation pressure which is in the operating range of the liquid ring pump can be obtained in the evaporator.

DETAILED DESCRIPTION

Figure 1:
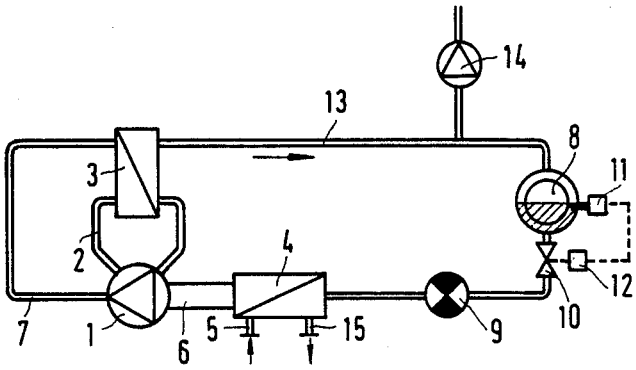
FIG. 1 is a schematic diagram of a first heat pump system according to the present invention.

FIG. 1 shows the loop of a heat pump system which operates in the low temperature range with water as the refrigerant. For compressing the steam generated, a vacuum pump 1 in the form of a liquid ring pump is provided, in the sealing liquid loop 2 of which a heat exchanger 3 is arranged.

Water in the temperature range of 0° to 10° C., for instance, river water, is fed via the inlet 5 to a heat collector designed as an evaporator 4, and is evaporated directly or indirectly. The steam is fed to the vacuum pump 1 via the steam line 6 and, after having been compressed, is transported from there at elevated temperature via the lines 7 and 13 to the heat consumer 8, for instance, a radiator. In the heat consumer 8, the steam is condensed; the condensate level is set by means of a valve 10 which can be controlled via a sensor 11 and a control device 12. The condensate is fed, otherwise, via the throttling valve 9, to the evaporator 4 to be evaporated again, or taken off behind the valve 10 if a direct evaporator is used. If an indirect evaporator is used, the water used as the heat source leaves the evaporator 4 via the outlet 15.

Since in the heat pump installation according to FIG. 1, steam in the temperature range of about 50° to 60° C. is generated, the system operates in the underpressure range on the consumer side. For this reason, a rough vacuum pump 14 is connected to the feed line 13 and continuously maintains the condensation pressure required in this system relative to the atmosphere. The rough vacuum pump 14 at the same time always keeps the entire system free of air.

Figure 2:
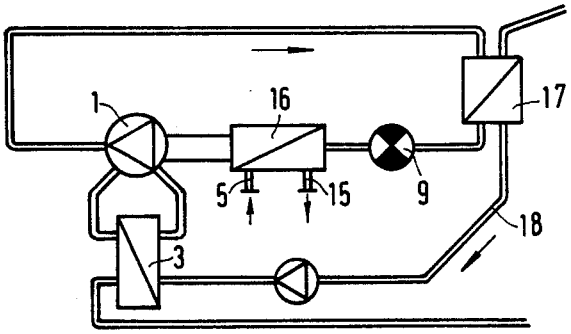
FIG. 2 is a schematic diagram of a second heat pump system according to the present invention.

In the heat pump installation according to FIG. 2, the return of a long distance heating network is fed to the evaporator 16 via the inlet 5 and leaves the evaporator via the outlet 15. In this case, the vacuum pump 1, again realized as a liquid ring pump, generates steam in the temperature range of 110° to 120° C., which is condensed in the heat exchanger 17 by means of a secondary heat carrier loop and is returned to the evaporator 16 via the valve 9. In this case, the heat exchanger of the liquid ring pump 1 is arranged in the loop 18 of the secondary heat carrier behind the heat exchanger 17.

Figure 3:
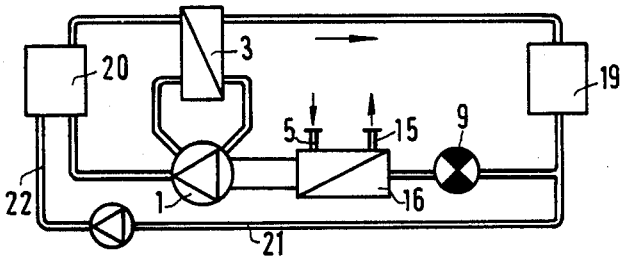
FIG. 3 is a schematic diagram of a third heat pump system according to the present invention.

In the heat pump installation according to FIG. 3, warm water with temperatures of 50° to 60° C. is likewise fed to the heat collector which is designed as an indirect evaporator 16, so that, with the aid of the liquid ring pump 1, steam is generated in the overpressure range. In the direct liquid condenser 20 following the vacuum pump, this steam is condensed by connecting its liquid input to the outlet of the heat consumer 19 via the line 21. The condensate formed in the condenser 20 is further heated by means of the heat exchanger 3 of the liquid ring pump 1.

Figure 4:
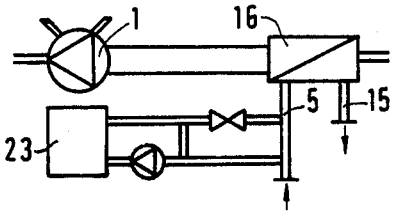
FIG. 4 is a schematic diagram of a fourth heat pump system according to the present invention.

According to FIG. 4, the liquid ring pump 1 can be driven by a water cooled combustion engine 23, through a drive shaft 24, through a drive shaft 24, where the water input to the indirect evaporator 16 is designed so that the cooling water of the combustion engine is fed to the evaporator as an additional heat source.

What is claimed is:

1. An improved heat pump installation for the transfer of heat from a medium at a lower temperature to a medium at a higher temperature, using a liquid heat carrier comprising:

a heat exchanger for collecting heat from a heat source at said lower temperature and transferring said heat to the liquid heat carrier thereby evaporating said carrier;

a compressor for compressing and transporting said evaporated carrier; and a heat consumer at said higher temperature for condensing said compressed carrier;

said heat exchanger, compressor and heat consumer arranged in an opened or closed loop, the improvement comprising the liquid-heat carrier being water and the compressor being a vacuum liquid-ring pump generating an underpressure on its suction side which has its sealing liquid a thermo-oil, whereby evaporation of the heat carrier in said heat exchanger is carried out by use of an underpressure.

2. A heat pump installation according to claim 1, and further including a rough vacuum pump connected to a steam line between the vacuum pump and the heat consumer and a controlled valve for controlling the amount of condensate in the heat consumer following the heat consumer.

3. A heat pump installation according to claim 1, wherein said evaporator comprises a direct liquid condenser disposed between the vacuum pump and the heat consumer, the liquid inlet of said condenser connected to the outlet of said heat consumer.

4. A heat pump installation according to claim 1, and further including a heat exchanger arranged in the loop of the sealing liquid, the heat output side of the heat exchanger being located in a primary or secondary loop of the heat consumer.

5. A heat pump installation according to claim 4, wherein said heat exchanger is disposed between the condenser and the heat consumer.

6. A heat pump installation according to claim 5, wherein said vacuum pump is driven by a water cooled combustion engine, and wherein the cooling water of said engine is fed to the heat collector as an additional heat source.

7. A heat pump installation according to any one of claims 1, 2 or 3, wherein said vacuum pump is driven by a water cooled combustion engine, and wherein the cooling water of said engine is fed to the heat collector as an additional heat source.

8. A heat pump installation according to claim 1, wherein said vacuum pump is driven by a water cooled combustion engine, and wherein the cooling water of said engine is fed to the heat collector as an additional heat source.

9. In a method for transferring heat from a medium at a lower temperature to a medium at a higher temperature by using a liquid heat carrier, said method comprising:

(a) collecting heat from a heat source at said lower temperature and transferring said heat to the liquid heat carrier to thereby evaporate said carrier;

(b) compressing and transporting said evaporated carrier through the use of a liquid-ring pump which has as its sealing liquid an oil; and (c) condensing said compressed carrier in a heat consumer at said higher temperature, said collecting, compressing and condensing being carried out in an opened or closed loop, the improvement comprising:

(d) using water as the liquid heat carrier;

(e) using a thermo-oil as a sealing liquid; and (f) operating the liquid-ring pump such that it generates a vacuum on the suction side of said pump in order to carry out evaporation of the water by means of an underpressure.

* * * * *